United States Patent [19]

Kunzli et al.

[11] Patent Number: 4,812,618

[45] Date of Patent: Mar. 14, 1989

[54] ELECTRODE BOILER AND AN INSULATOR THEREFOR

[75] Inventors: Albert Kunzli, Wiesendangen; Kurt Schutz, Winterthur, both of Switzerland

[73] Assignee: Sulzer Brothers Limited, Winterthur, Switzerland

[21] Appl. No.: 57,483

[22] Filed: Jun. 3, 1987

[30] Foreign Application Priority Data

Jun. 18, 1986 [CH] Switzerland ..... 2462/86

[51] Int. Cl.[4] ..... H05B 3/60

[52] U.S. Cl. ..... 219/288

[58] Field of Search ..... 219/288, 290; 174/158 R, 178, 179, 209; 338/82

[56] References Cited

U.S. PATENT DOCUMENTS 4,292,498 9/1981 Rouf ..... 219/291 X 4,314,139 2/1982 Williams et al. ..... 219/288 X

*Primary Examiner*—Clifford C. Shaw

*Assistant Examiner*—M. M. Lateef

*Attorney, Agent, or Firm*—Kenyon & Kenyon

[57] ABSTRACT

The insulator for mounting the electrode within the vessel of the boiler includes a hollow moulding of fluoroplastic material and a support member for transmitting mechanical forces. The support member is in the form of a hollow tube which is slidably received at opposite ends in an annular recess of the moulding.

10 Claims, 1 Drawing Sheet

ELECTRODE BOILER AND AN INSULATOR THEREFOR

BACKGROUND OF THE INVENTION

This invention relates to an electrode boiler and to an insulator therefor. More particularly, this invention relates to an electrode boiler for producing steam or hot water.

Heretofore, various types of electrode boilers have been known for the production of steam or hot water. Generally, such electrode boilers are constructed with a vessel which is partly filled with water and which contains at least one electrode which can be connected to an alternating-current power supply in order to heat the water within the vessel. In addition, the electrode has been mounted within the vessel by means of an electrical insulator of ceramic material which is situated above the level of the water.

Generally, boilers of the above type have a counter electrode associated with the electrode and which is also electrically connected to the vessel. In such cases, water falling between the electrode and the counter electrode forms an electrical current path. However, during operation, it has been observed that substances contained in the water are carried by the steam that forms and/or by splashes of water into the insulator area and are deposited on the surface of the insulator in the form of crystals. As a result, a dangerous condition can be presented if the deposits coalesce to form electrically conductive layers which are liable to cause short circuits. Further, the deposits attack the ceramic insulator chemically so that the surface of the insulator progressively roughens so as to favor the creation of deposits and, thus, increase the risk of short circuits. In addition, the insulators are subjected to mechanical stresses which may lead to destruction of the insulators particularly since the ceramic insulators are made of brittle material. As a result, the insulators must be changed frequently causing undesirable interruptions in operation.

Accordingly, it is an object of the invention to reduce or completely eliminate the possibility of fracture of an insulator of an electrode boiler.

It is another object of the invention to increase the life of an insulator in an electrode boiler.

SUMMARY OF THE INVENTION

Briefly, the invention provides an insulator for an electrode boiler which is comprised of an electrically insulating hollow molding of fluoroplastic material having a longitudinal axis and a support mumber for transmitting mechanical forces extending in the molding in parallel to the axis of the molding. The molding includes an annular recess in which a support member in the form of a hollow tube can be slidably received at least at the opposite ends. In addition, the molding extends over a substantial portion of the support member.

The insulator is suitable for use in an electrode boiler having a vessel for receiving a supply of water, at least one electrode in the vessel for heating the water and means for connecting the electrode to an alternating-current power supply. In this respect, the electrical insulator serves to mount the electrode in the vessel and is, in turn, by a suitable mounting means in the vessel.

The mounting means is also provided with a recess to receive an end of the insulator with the molding clamped between the support member and the mounting means.

The subdivision of the insulator into the molding and the support member separates the functions of electrical insulation and the transmission of mechanical forces, so simplifying the construction of the two members. Since the support member need no longer be of ceramic material and can now be made from conventional structrual steel, there is practically no risk of the insulator breaking. Extended time tests have shown, moreover, that substantially no deposits occur on the extremely smooth surface of the fluoroplastic moulding. Hence corrosion of the insulator, the risk of short circuits and frequent changing of the insulator are eliminated.

The fluoroplastic material used for the molding may be a polyetetrafluoroethylene which is particularly advantageous at high temperatures as occur in steam-generating electrode boilers.

These and other objects and advantages of the invention will become more apparent from the following detailed description taken in conjunction with the accompanying drawings wherein:

DESCRIPTION OF THE PREFERRED EMBODIMENTS

Figure 1:
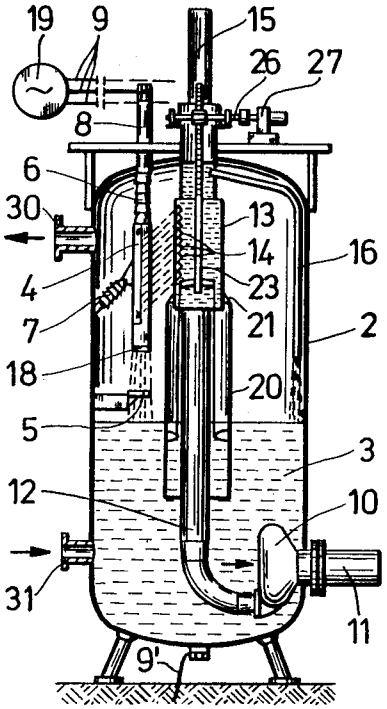
FIG. 1 illustrates a cross sectional view of an electrode boiler of water jet type employing an insulator in accordance with the invention.

Referring to FIG. 1, the electrode boiler is of a water jet type and includes a cylindrical vertically disposed vessel 2 which is closed at both ends and which is filled approximately half full of water 3. As illustrated, the boiler has for example three electrodes 4 only one of which is shown for heating the water which is supported by a ceramic electrical insulator 6 to depend downwardly from an upper end of the vessel 2. This insulator 6 insulates the electrode 4 electrically from the vessel 2 while another ceramic insulator 7 supports the electrode 4 against the vertical wall of the vessel 2 in order to prevent horizontal deflection of the electrode 4, for example, in the event of earthquakes.

A pump 10 which is driven by an electric motor 11 and which is submerged in the water 3 supplies water through a central riser 12 to a nozzle assembly 13 and into an adjoining housing 15 provided with an overflow duct 16 through which water flows back into the lower part of the vessel 2.

The nozzle assembly 13 is in the form of a vertical hexagonal prism with alternating sides having a series of central nozzles 14 which are arranged vertically on above the other to form parallel water jets which are directed onto the associated electrode 4. The water which strikes each electrode 4 falls onto a nozzle plate 18 which is in the form of a perforated sheet and which is attached to the lower end of the electrode 4.

A counter electrode 5 is positioned between the nozzle plate 18 and the level of water in the vessel 2. This counter electrode 5 is in the form of a metal plate containing vertically disposed bores and is attached to the vessel 2 in an electrically conductive manner as is known.

Figure 2:
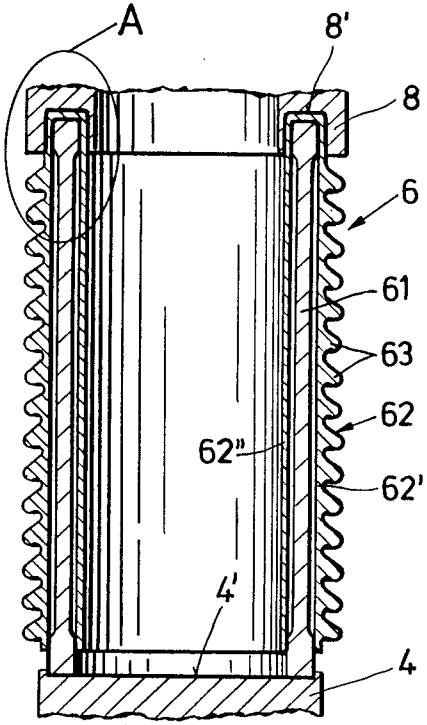
FIG. 2 illustrates a cross sectional view of an insulator constructed in accordance with the invention.

Referring to FIG. 2, the upper insulator 6 is substantially tubular and is rigidly connected at the bottom to the electrode 4 and at the top to a mounting means in the form of a penetration duct 8.

In addition, a means in the form of a conductor 9 is provided for connecting each electrode 4 to an alternating-current power supply 19. As indicated, each conductor 9 extends from the electrode 4 through a bore of the insulator 6 and through the penetration duct 8 in electrically insulated manner to the power supply 19.

The insulator 7 which is of similar construction to the insulator 6 has one end connected rigidly to the wall of the vessel 2 and the opposite end pivotally connected to the electrode 4. The vessel 2 is also provided with an earth lead 9' so that the water jets between the nozzle plate 18 and the counter electrode 5 form a current path for the alternating current. Because of the electrical resistance of the water jets, the water in the jets is heated and partially evaporates. The resulting steam escapes through an outlet spigot 30 in the vessel 2 to consuming devices (not shown). A suitable inlet spigot 31 is also provided in the wall of the vessel 2 in order to supply the water into the vessel 2.

The output of the electrode boiler is controlled by means of a cylindrical, vertically movable regulating hood 20 which is placed around the riser 12 and nozzle assembly 13. This hood 20 carries a wiper ring 21 at the upper end which slides over the nozzle assembly 13. In order to effect axial motion of the hood 20, a vertical coaxial rack 23 is connected to the hood 20 and engages a gear which is driven by way of a shaft 26 via a reversible gear motor 27. The more the regulating hood 20 is raised, the more nozzles 14 are covered by the wiper ring 21 and the fewer water jets are impinged on the electrode 4 so that the quantity of water reaching the counter electrode 5 is reduced as is the quantity of steam.

Figure 3:
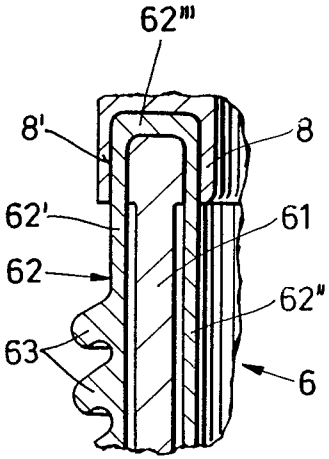
FIG. 3 illustrates an enlarged detail of the insulator of FIG. 2.

Referring to FIGS. 2 and 3, the insulator 6 is comprised of a substantially hollow-cylindrical support member 61 and an electrically insulating, hollow moulding 62 of fluoroplastic, for example, polytetrafluoroethylene. The moulding 62 has an annular recess defined by an outer envelope 62' with annular beads 63 distributed along the length and an inner envelope 62''. The support member 61 is in the form of a hollow tube with enlarged ends which are received in the recess of the molding 62 and serves to transmit the mechanical forces acting on the insulator 6 to the mounting means 8.

As indicated in FIG. 2, the tubular support member 61 extends between the envelopes 62', 62'' of the molding 62. In addition, the molding 62 has a connecting portion 62'''connecting the two envelopes 62', 62'' and bridging over the support member 61 to cover the end of the support member 61.

The molding 62 extends over a substantial portion of the support member 61 and almost to the bottom end of the support member 61. At the lower end of the insulator 6, the support member 61 fits into a cylindrical recess 4' in the electrode 4 while the upper end fits into a recess in the form of an annular groove 8' in the duct 8. At this fastening end of the insulator 6, the moulding 62 is clamped fast between the support member 61 and the groove 8'. Flow or yield of the plastic at the fastening point is therefore prevented, even under high mechanical stress and at high temperatures. This ensures both a secure connection between the insulator 6 and the adjoining components, and adequate electrical insulation.

Mechanical connection of the insulator 6 to the duct 8 and to the electrode 4 may, for example, be by means of a hollow screw (not shown) which is coaxial with the insulator 6, and through whose interior the conductor (not shown) extends.

The electrical conductivity of the water can be optimized by adding electrolytes (salts or bases). However, these and other substances contained in the water tend to be deposited in crystal in the interior of the vessel 2. Insofar as this affects the insulators 6, 7 above the water level, the deposits may have serious consequences. The fluoroplastic moulding 62 however, prevents such deposits on the insulators 6, 7, since the surface of the moulding 62, is so smooth and resistant to chemical attack that no appreciable deposits occur.

The output of the electrode boiler may alternatively be adjusted so that only hot water is produced. The insulator may also be used in other types of electrode boilers, for example, those in which the electrode and counter electrode are each in the form of a dish with an overflow edge for the water, or in which the electrode and counter electrode are arranged coaxially one inside the other and immersed in water.

The invention thus provides an insulator for an electrode boiler which resists fracturing and which is able to resist mechanical stresses. As such, the need to change insulators from time-to-time due to cracking or fracture is substantially reduced if not eliminated.

The invention also provides an insulator which can be readily mounted in an electrode boiler.

The invention also provides an insulator for use in an electrode boiler which resists the build-up of water deposits thereon. As such, the insulator reduces the risk of short circuits occurring while also protecting the insulator from surface corrosion.

The invention further provides an insulator which can be used in an electrode boiler to extend the life of the boiler.

What is claimed is:

1. An electrode boiler comprising a vessel for receiving a supply of water;

at least one electrode in said vessel for heating said water therein;

means for connecting said electrode to an alternating-current power supply; and an electrical insulator mounting said electrode in said vessel, said insulator including an electrically insulating hollow moulding of fluoroplastic material having a longitudinal axis and a support member for transmitting mechanical forces extending in said moulding parallel to said axis.

2. An electrode boiler as set forth in claim 1 wherein said moulding is made of polytetrafluoroethylene.

3. An electrode boiler as set forth in claim 1 which further comprises a mounting means for mounting said insulator within said vessel, said mounting means having a recess receiving one end of said insulator with said moulding clamped between said support member and said mounting means.

4. An electrode boiler as set forth in claim 3 wherein said moulding includes an annular recess receiving said support member.

5. An electrode boiler as set forth in claim 4 wherein said support member is a hollow tube slidably received at opposite ends in said recess of said moulding.

6. An insulator for an electrode boiler comprising an electrically insulating hollow moulding of fluoroplastic material having, a longitudinal axis and an annular recess concentric to said axis; and a support member for transmitting mechanical forces extending in said recess of said moulding parallel to said axis.

7. An insulator as set forth in claim 6 wherein said support member is a hollow tube extending concentrically of said axis.

8. An insulator as set forth in claim 6 wherein said moulding extends over a substantial portion of said support member.

9. An insulator as set forth in claim 6 wherein said support member is slidably received in said moulding at opposite ends of said member.

10. An insulator as set forth in claim 6 wherein said moulding is made of polytetrafluoroethylene.

* * * * *

UNITED STATES PATENT AND TRADEMARK OFFICE

CERTIFICATE OF CORRECTION

PATENT NO. : 4,812,618

DATED : March 14, 1989

INVENTOR(S) : Albert Kunzli

It is certified that error appears in the above-identified patent and that said Letters Patent is hereby corrected as shown below:

Column 1, line 66 after "turn," insert -mounted-
Column 2, line 57 change "on" to -one-

Signed and Sealed this

Fifth Day of March, 1991

*Attest:*

HARRY F. MANBECK, JR.

*Attesting Officer*

*Commissioner of Patents and Trademarks*